US005145183A

United States Patent [19]

Gates

[11] Patent Number: 5,145,183

[45] Date of Patent: Sep. 8, 1992

[54] METHOD OF PLAYING A WORD FORMING GAME

[76] Inventor: John Gates, 904 Winterbury Dr., Fayetteville, N.C. 28314

[21] Appl. No.: 802,619

[22] Filed: Dec. 5, 1991

[51] Int. Cl.[5] ..... A63F 3/00

[52] U.S. Cl. ..... 273/240; 273/272; 273/248

[58] Field of Search ..... 273/272, 240, 248

[56] References Cited

U.S. PATENT DOCUMENTS 3,746,342 7/1973 Fine ..... 273/272
4,884,815 12/1989 Glenn ..... 273/272
4,923,199 5/1990 Hahn ..... 273/272
5,048,842 9/1991 Proctor ..... 273/248

*Primary Examiner*—Benjamin H. Layno
*Attorney, Agent, or Firm*—Daniel Watlington

[57] ABSTRACT

A word-forming game comprising of a game board, game rules, pegged game pieces, word cards, playing pads, a timer, pencils, and a numbered die. Players form words from the letters of the word cards using the pencil and pad provided. Players are awarded points by forming words other players have not formed. Each round consists of drawing of a new word card. The winner is the player who has collected enough points to move his or her game piece to the finish.

3 Claims, 2 Drawing Sheets

METHOD OF PLAYING A WORD FORMING GAME

BACKGROUND OF THE INVENTION

1. Field of the Invention

The field of invention or field of art to which this invention pertains is the game field, to be more specific, word-forming board games.

2. Description of the Prior Art

The prior art is replete with various types of word-forming games which, for the most part, utilize words which are built from pre-existing letter tiles or the like. There are word-forming games which are played on an individual basis, but the present invention allows an individual to compete against another to make the existing word-forming games new and interesting.

The title of this word-forming game shall be known as A-F-T-E-R-W-O-R-D-S.

DETAILED DESCRIPTION OF THE DRAWINGS

While the present invention will be described fully hereinafter with reference to the accompanying drawings, in which a particular embodiment is shown, it is to be understood at the outset that persons skilled in the art may modify the invention herein described while still achieving the desired results of this invention. Accordingly, the description which follows is to be understood as a broad informative disclosure directed to persons of skill in the appropriate arts and not as limitation upon the present invention.

Figure 1:
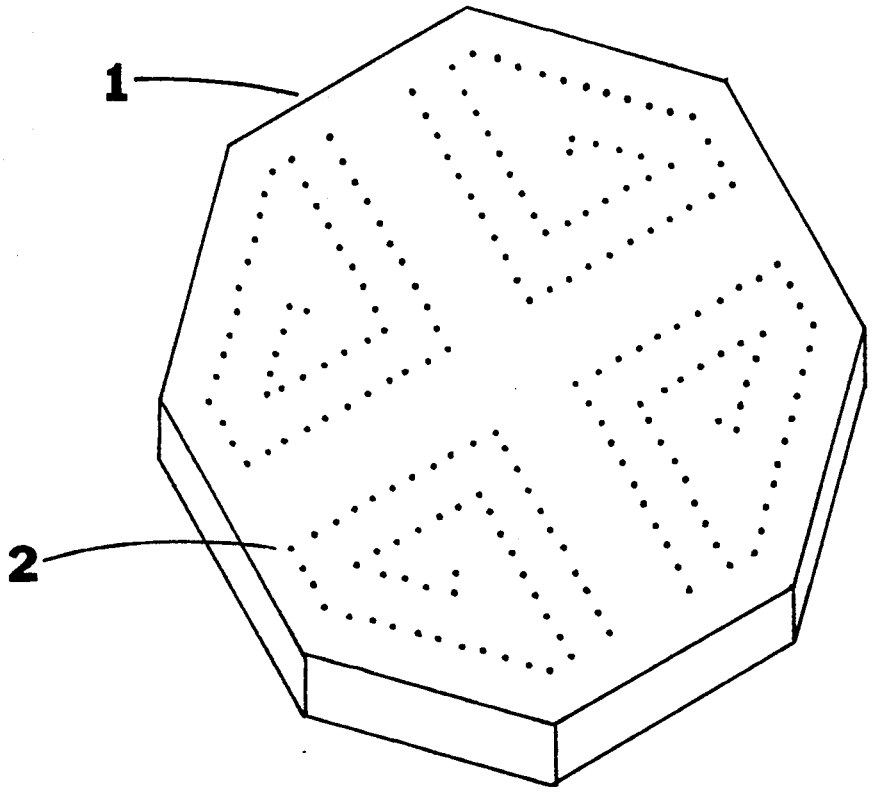
FIG. 1 is an illustrative drawing of the game board.
Figure 2:
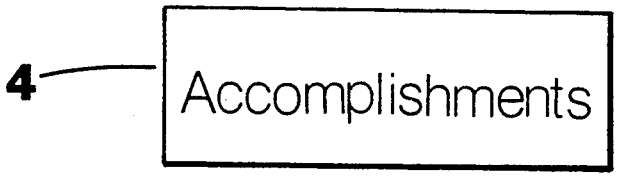
FIGS. 2 through 7 are drawings of the equipment. The word card (FIG. 2), the colored game peg (FIG. 3), the writing pad (FIG. 4), the pencil (FIG. 5), the numbered die (FIG. 6) and the timer (FIG. 7).
Figure 5:
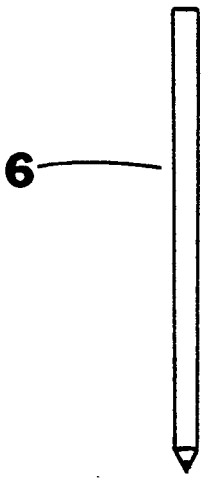
Figure 3:
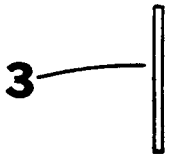
Figure 6:
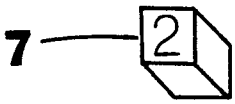
Figure 4:
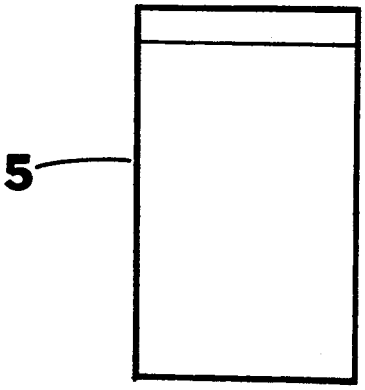
Figure 7:
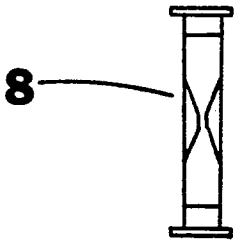

Referring to FIG. 1 the word-forming game is played on a geometrically shaped board 1 which has four individual playing areas which form four separate paths 2. On these paths, each player uses their colored pegs 3 to travel to the end as each player accumulates points from forming words.

Referring to FIGS. 2 through 7 a round is started by drawing a word card 4 then starting the timer 8. Each player uses a writing pad 5 and a pencil 6 to record the words derived from the base on the word card 4. After the allotted time has expired, the players eliminate all the words that are shared by one or more players and each player receives points based on the remaining words. The total points per round is the number of spaces the colored pegs 3 are moved. At the end of each round, a bonus roll of the numbered die 7 is awarded to every player over a set number of points in the previous round.

The foregoing embodiments and examples are to be considered illustrative, rather than restrictive of the invention, and those modifications which come within the meaning and range of equivalence of the claims are to be included therein.

RULES

Equipment 500 word cards
4 game pieces (red, yellow, green, and blue)

4 pads of playing paper
4 pencils
1 numbered die
1 one minute timer
1 playing board.

OBJECTIVE

The objective of the word-forming game is to be the first player to collect enough points from the basewords to move your game piece to the finish line.

PLAY

A card is drawn from the deck and placed in clear view of all the players. Each player then has one minute to make as many words as he or she can using the letters of the baseword.

Each letter can only be used as many times as it appears in the baseword. A two syllable baseword may not be split in half to form two words, such as BRICK-HOUSE, the word BRICK or HOUSE can not be used. You may not use a word and then use it's plural, such as, DOG-DOGS, CAR-CARS, etc. No two letter words can be used. Words whose plurals are different, such as, GOOSE-GEESE, MOUSE-MICE may be used.

At the end of each round, players stop and compare words. If two or more players share the same word, all players will cross it out and no points will be awarded for that word. Players will receive one point for one syllable words, three points for two syllable words, and four points for three syllable words.

BONUS

At the end of each round, players will total all their points. Each player with twelve or more points will be awarded one roll of the numbered die. Players (with over twelve points) will move forward the number of points received from their words plus the amount rolled from the die. Players with eleven points or less will move forward only the amount from their words.

EXAMPLE

"Accomplishments"

| | | |
|---|---|---|
| 1 | shipment | 3 points |
| 2 | mat | 1 point |
| 3 | mint | 1 point |
| 4 | compass | 3 points |
| 5 | plastic | 3 points |
| 6 | halite | 3 points |
| 7 | shape | 1 point |
| 8 | stamp | 1 point |
| 9 | plate | 1 point |
| 10 | hamlet | 3 points |
| | TOTAL POINTS 20 | |

I claim:

1. A method of playing a word forming game for two or more players comprising the steps of:

a) providing a plurality of cards representing a plurality of different base words wherein each card having only one base word inscribed thereon;

b) providing each player with a paper and a writing instrument;

c) providing a timing means for setting a predetermined time limit;

d) starting a round by drawing a card and positioning the card such that the base word on the card is in clear view of all the players;

e) starting the timing means;

f) each player, as quickly as possible, writing on their paper as many different words as possible wherein the letters used in forming the written words are only the letters in the base word, and using these letters as many times on a written word as it appears on the base word;

g) at the end of the predetermined time limit, players stop writing;

h) players comparing their written words wherein if two or more players share the same written word, all players having the shared written word crossing out the shared written word from their papers;

i) providing point values to the written words wherein a written word having one syllable is worth one point, a written word having two syllables is worth three points and a written word having three syllables is worth four points;

j) each player determining the points awarded to them for the round by placing point values to each of their written, non-crossed out words as recited in step i) and totalling the point values;

k) repeating steps d)–j) until a predetermined number of rounds have been played;

l) totalling the point values of each round, wherein the player having the-most total points wins.

2. A method according to claim 1 further providing a scoreboard comprising a geometrically shaped game board having a plurality of pegholes on its playing surface, the pegholes form playing paths, one for each player, a plurality of variously colored pegs, one for each player, the pegs being sized for reception in the pegholes, players keeping track of their score by moving their pegs from one peghole to the next on a playing path according to the number of points awarded.

3. A method according to claim 1 further providing a die having a plurality of faces, each face having a different number inscribed thereon, each player awarded twelve or more points in a round, being allowed to roll the die and additionally receive points equal to the number appearing on the die.

* * * * *